US005761996A

United States Patent [19]

Gauthier et al.

[11] Patent Number: 5,761,996

[45] Date of Patent: Jun. 9, 1998

[54] PIVOTING TIME RECORDER

[75] Inventors: Walter P. Gauthier, Westford; Glenn L. Sindledecker, Dracut, both of Mass.

[73] Assignee: Simplex Time Recorder Company, Gardner, Mass.

[21] Appl. No.: 523,074

[22] Filed: Aug. 31, 1995

[51] Int. Cl.[6] ..... B41J 29/38

[52] U.S. Cl. ..... 101/93; 101/72; 101/78; 101/292

[58] Field of Search ..... 101/91, 92, 93, 101/72, 78, 297, 66, 69, 70, 269, 292; 235/101; 400/328

[56] References Cited

U.S. PATENT DOCUMENTS

| | | | |
|---|---|---|---|
| 2,087,315 | 7/1937 | Bugg et al. | 101/297 |
| 3,211,371 | 10/1965 | Bolger | 101/297 |
| 3,583,314 | 6/1971 | Gillender | 101/91 |
| 3,908,544 | 9/1975 | Seidl et al. | 101/292 |
| 4,003,307 | 1/1977 | Sano et al. | 101/45 |
| 4,415,801 | 11/1983 | Franke | 235/101 |
| 4,475,831 | 10/1984 | Drejza | 400/279 |
| 4,655,132 | 4/1987 | Weickert et al. | 101/269 |
| 4,712,114 | 12/1987 | Kikuchi | 101/66 |
| 4,787,761 | 11/1988 | Tezuka et al. | 400/328 |
| 4,899,173 | 2/1990 | Elliano | 346/82 |
| 5,048,414 | 9/1991 | Hoshino | 101/78 |
| 5,136,937 | 8/1992 | Nogawa | 101/72 |
| 5,189,953 | 3/1993 | Kennedy et al. | 101/269 |

OTHER PUBLICATIONS

Centennial Installation, Operating and Programming Instructions, *Simplex Time Recorder Co.*, Gardner, Massachusetts CEN-21-001 (574-256), pp. 1-20, ED 12 88.

Electronic Time Recorder, PIX-3000 Series, Operation Manual, *Amano Cincinnati*, Cincinnati, Ohio, pp. 1-22, AJR-1511.

Operations Manual, PIX-10 Electronic Time Recorder, *Amano Cincinnati, Inc.*, Cincinnati, Ohio, 20M-1093.

HA Series Time, Date and Numbering Stamps, *Simplex Time Recorder Co.*, Gardner, Massachusetts, 1601 Series, Publication S1601-0001 6-91.

*Primary Examiner*—Christopher A. Bennett

*Attorney, Agent, or Firm*—Hamilton, Brook, Smith & Reynolds, P.C.

[57] ABSTRACT

In a pivoting time recorder, an inner frame is erected from a base. A printer assembly interfaces with the inner frame at a pivot. The pivot and printer assembly are suspended over the base, forming a slot for insertion of a document therebetween. The printer assembly includes a barrel cam having a protrusion adapted to interface with a cam follower integrated on the inner frame for raising and lowering the printer relative to the base about the pivot. The barrel cam induces axial movement in a programmable printer adapted to be driven by the barrel cam. A motor rotates the barrel cam for moving the printer axially and for raising and lowering the printer assembly relative to the base. The present invention operates with very little movement—only 2° of rotation about the pivot point, resulting in a more reliable design having a lower manufacturing cost in comparison to time recorders of the prior art.

29 Claims, 12 Drawing Sheets

PIVOTING TIME RECORDER

BACKGROUND OF THE INVENTION

In current programmable time recorders, a printer is commonly mounted on a frame suspended above a base. This creates a slot for insertion of a document or other print medium. To accomplish this, one model moves the printer frame upward and downward along a guide shaft erected from the base. A barrel cam mounted to the printer frame moves a printer coupled thereto in forward and reverse directions. A spring pulls the printer frame toward the base to secure the document during printing. A cam disk mounted to one end of the barrel cam raises the frame up along the guide shaft when the printer moves in one direction and lowers the frame when the printer moves in the opposite direction. The printer frame is slidably mounted on the guide shafts with plastic bearings for a smooth fit.

In another design, an inner frame supports a printer, printer electronics, and a user display. The inner frame is suspended above a base to provide a slot for insertion of a document. The printer does not move vertically relative to the base, but rather a platen rises from the base upon insertion of a document thereon to position the document for printing.

The aforementioned designs are mechanically complex and require a large amount of movement to position the document or printer for printing. The steel guide shafts of the first design must be precision machined and the plastic bearings supporting the frame on the guide shafts tend to wear. With heavy, steel parts, the recorders are not conducive to wall mounting. Because of the mechanical complexity and precision machining, these designs are expensive to manufacture.

SUMMARY OF THE INVENTION

The present invention is directed to an apparatus and method for printing data on a print medium. The apparatus of the invention comprises a time recorder including a printer assembly, an inner frame, and a base. The inner frame is erected from the base to support the printer assembly.

The printer assembly interfaces with the inner frame at a pivot to suspend the printer assembly over the base, forming a slot for insertion of a print medium therein. The printer assembly includes a barrel cam having a protrusion or lifting cam adapted to interface with a cam follower integrated on the inner frame for raising and lowering the printer relative to the base about the pivot. The barrel cam induces axial movement in a programmable printer adapted to be driven by the barrel cam. A motor rotates the barrel cam for moving the printer axially and for raising and lowering the printer assembly relative to the base. Upon insertion of a document, the motor induces barrel cam rotation causing the printer assembly to rest on the document which secures the print medium for printing. After printing, the cam follower causes the printer assembly to lift, allowing for removal of the printed document.

In a preferred embodiment, a spring inserted between the printer assembly and the inner frame provides a compressive force therebetween for forcing the printer against the base when the lifting cam releases from the cam follower. The barrel cam preferably includes a raised rail for guiding the printer axially so that the barrel cam can be molded in a single piece.

The present invention offers many significant improvements over the time recorders of the prior art. Mechanically, it is much simpler, requiring only 2° of rotation of the printer assembly about the pivot point for raising and lowering the printer. This is in contrast with the vertical motion of the prior art recorders, which use expensive precision shafts and bearings likely to wear. The pivot is molded in the inner frame and printer frame, and the lifting cam is molded in the barrel cam, reducing the number of required components. The present invention is targeted for 1,000,000 print cycles, as compared to the prior art recorders which are designed for 200,000 print cycles. Thus, the present invention offers a less complicated, more reliable design with a lower manufacturing cost than currently-available recorders.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF PREFERRED EMBODIMENTS

Figure 1:
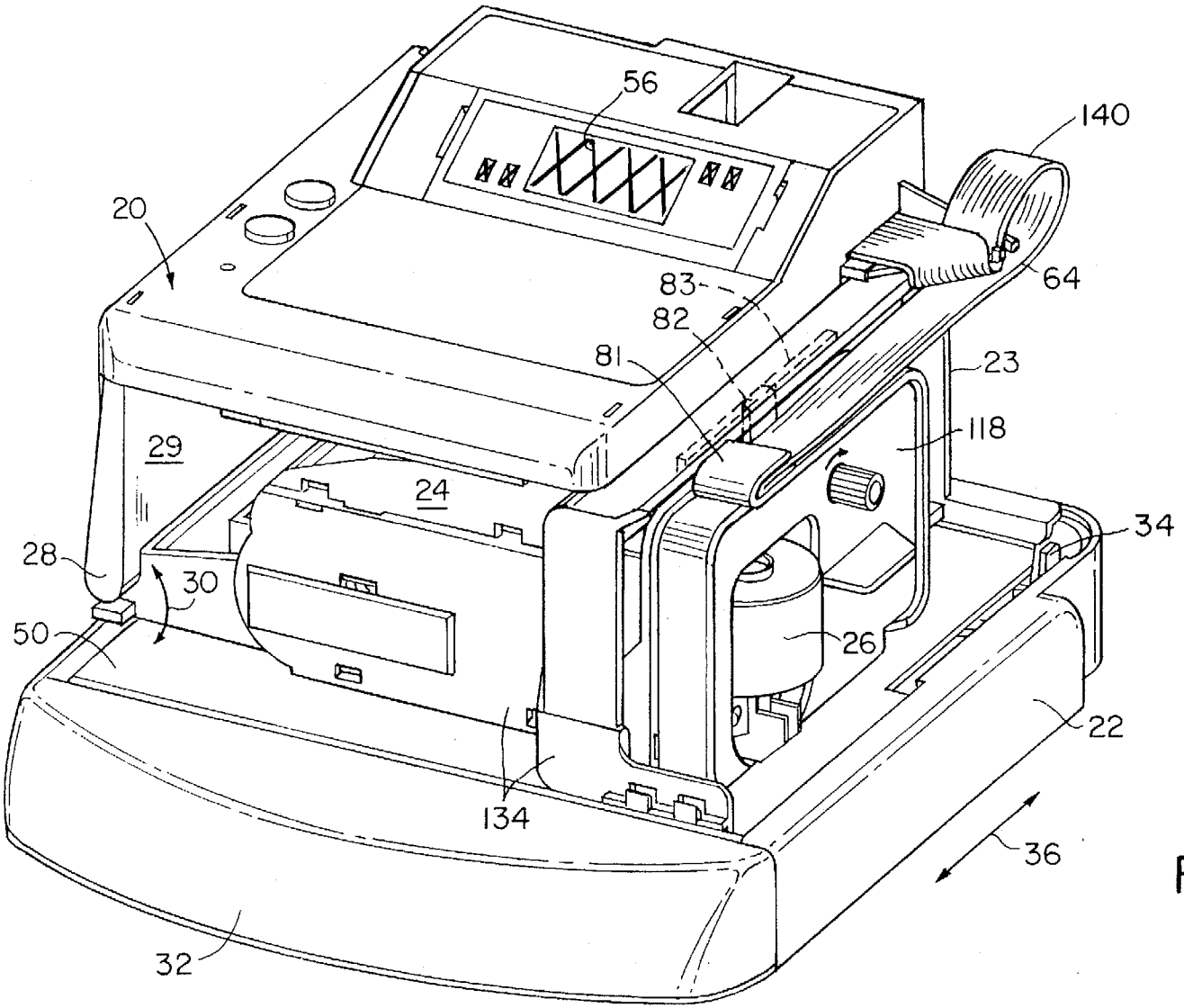
FIG. 1 is a perspective view of a pivoting time recorder in accordance with the present invention.

FIG. 1 is a perspective view of a preferred embodiment of a time recorder in accordance with the present invention. The primary components of the recorder include a base 22, an inner frame 20, and a printer assembly 24. The inner frame 20 is rigidly erected from the rear of the base 22 at a rear wall 23 and cantilevered over the base 22 to support a user interface 56. A pair of pivot supports 28 are formed in a suspended side wall 29 of the inner frame 20. The side wall 29 is suspended over the base 22 from the main body of the inner frame 20. The printer assembly 24 is pivotally mounted on the inner frame 20, supported by the pivot 28, and includes a printer 26, driven by a motor 120 and barrel cam 104 (see FIG. 8) for axial movement of the printer 26 in forward and reverse directions shown by arrow 36 on an inserted print medium 130.

While in a dormant mode, the printer assembly 24 is raised relative to the base 22 to provide a slot for insertion of a print medium therebetween. Upon insertion of a print medium in the slot, the motor 120 (see FIG. 8) initiates a print sequence by rotating the barrel cam 104 (see FIGS. 5A and 5B). The barrel cam 104 includes a protrusion 110 which operates as a lifting cam by engaging a cam follower 62 integrated on the rear wall 23 of the inner frame 20 (see FIG. 3B). As the barrel cam 104 rotates, the lifting cam 110 disengages from the cam follower 62 and lowers the printer assembly 24 onto the inserted print medium. As it lowers, the printer assembly 24 rotates about the pivot 28 in the direction shown by arrow 30. A spring 66 (see FIG. 8) held in compression between the top side of the printer frame 24 and the underside of the inner frame 20 forces the printer assembly 24 against the base (see FIG. 8). In wall-mounted applications, the time recorder is reoriented to hang on the wall with the underside of the base 22 against the wall. The spring 66 is especially useful in this embodiment because gravity does not serve to force the printer assembly 24 against the base.

During a print sequence, the barrel cam 104 (see FIG. 8) rotates to induce motion in the printer 26 in an axial direction as shown by arrow 36. After printing a line, the barrel cam 104 returns the printer 26 to its home position and raises the printer assembly 24 relative to the base 22. When the printer assembly is raised, it rotates about its pivot 28 in the direction shown by arrow 30. This releases the force of the printer assembly 24 and spring 66 from the base 22, permitting removal of the printed document.

Figure 2:
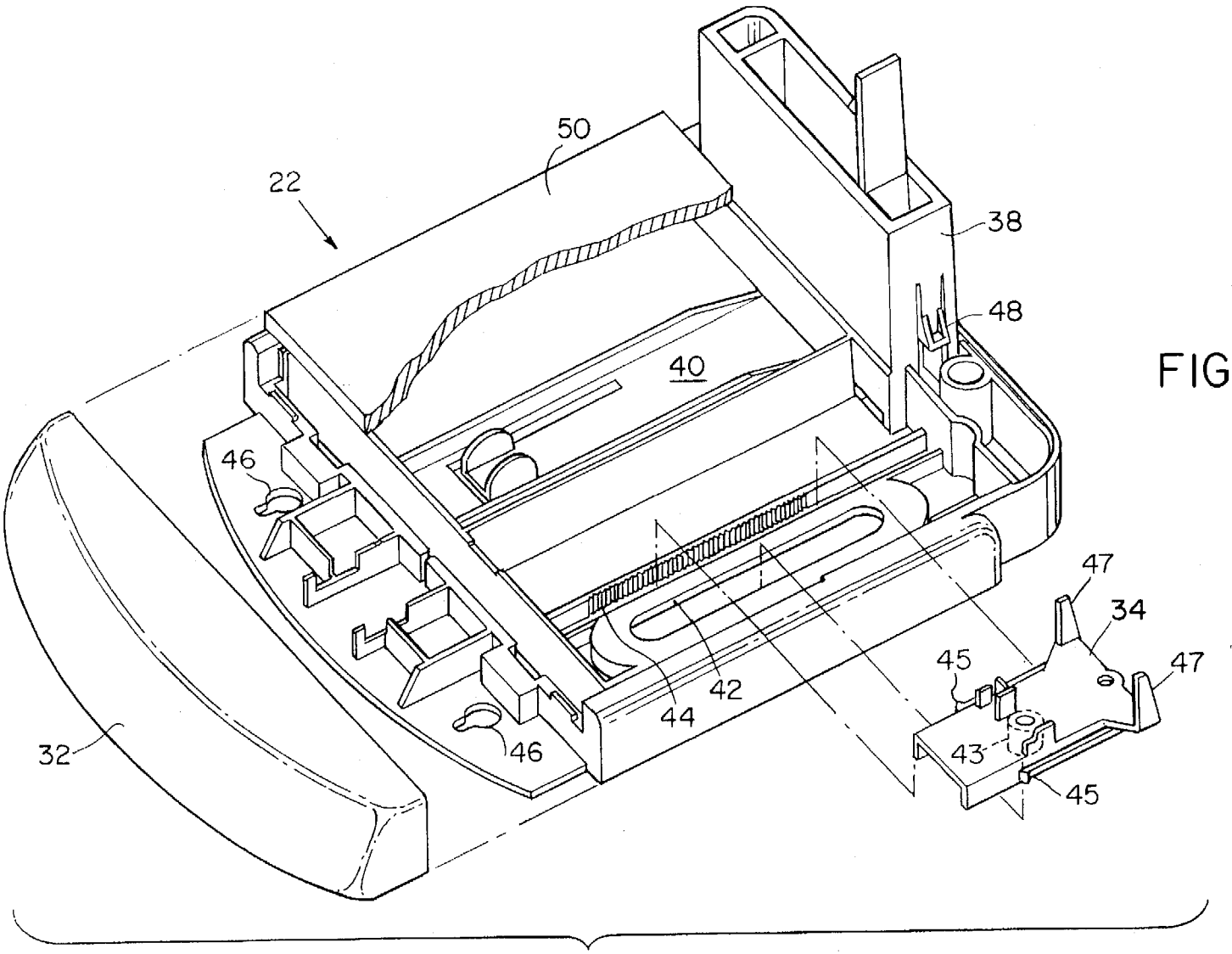
FIG. 2 is an exploded perspective view of the base for a time recorder in accordance with the present invention.

FIG. 2 is an exploded perspective view of the base 22, manual switch 32, and card stop 34. The base 22 includes a mounting box 38 adapted to interface with the inner frame 20. Tabs 48, formed on the mounting box 38, secure the inner frame 20 on the mounting box 38. The mounting box 38 is hollow to allow for passage of electrical conductors between the base 22, a computer board (not shown) mounted within an upper section 68 of the inner frame (see FIG. 3B), and printer 26. A battery housing 40 contains batteries which provide an alternative power source upon removal of AC power from the unit. An adjustable card stop 34 mounts in the base for controlling the depth of print medium insertion. Ratchet teeth 44 formed in the base 22 interface with fingers 45 formed on the card stop 34. A protrusion 43 formed on the underside of the card stop 34 interfaces with a card stop groove 42 formed on the base 22, for guiding the card stop 34 in the base 22. Stoppers 47, formed in the top of the card stop 34, regulate the depth of insertion of the print medium. The manual switch 32 activates the controller for initiating a print sequence. Wall mount holes 46 are provided underneath the manual switch 32 for securing the recorder to a wall.

Figure 3A:
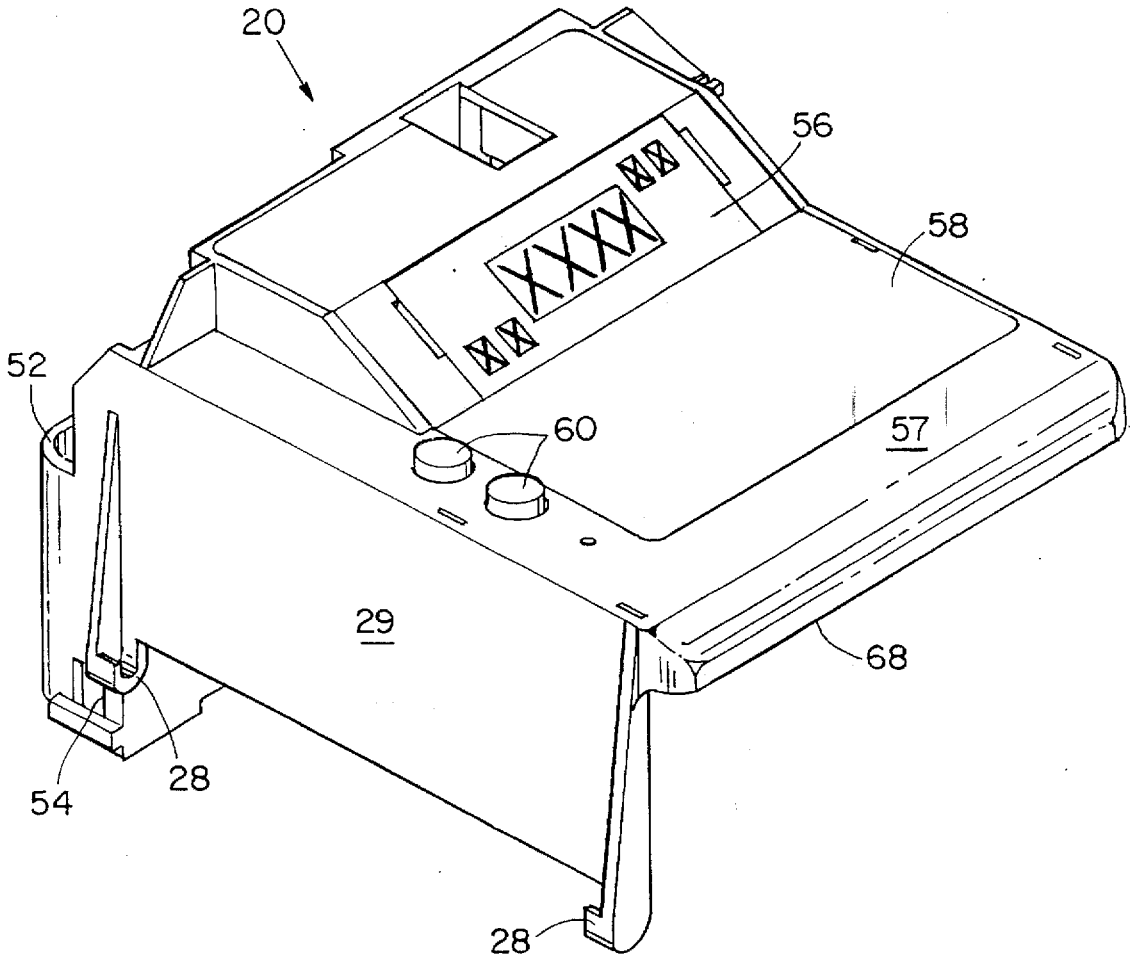
FIG. 3A is a front perspective view of the inner frame for a time recorder in accordance with the present invention.
Figure 3B:
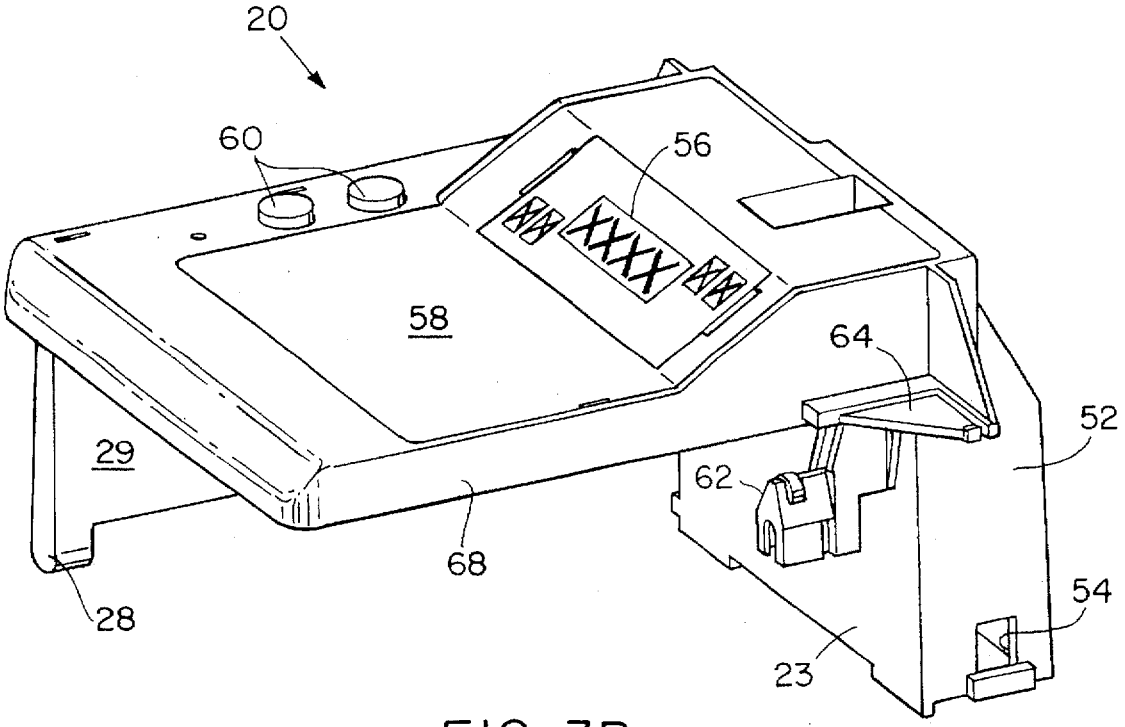
FIG. 3B is a front perspective view of the right side of the inner frame.

FIGS. 3A and 3B are perspective views of the left and right sides of the inner frame 20. The inner frame 20 comprises an integrally-molded sleeve 52, top panel 57 and side wall 59. The sleeve 52 mates with the mounting box 38 of the base 22 (see FIG. 2). Slots 54 on the sleeve 52 interface with tabs 48 on the mounting box 38 for securing the inner frame 20 to the base 22. The side wall 29 of the inner frame 20 is suspended from the top panel 57. This allows for insertion and removal of documents on three sides of the time recorder and allows for insertion of documents which are larger than the surface area of the base 22. Pivot supports 28 are formed in the side wall 29 for supporting the printer frame 24 (see FIGS. 4A and 4B).

The top panel 57 includes programming buttons 60, a display 56 and an instruction panel 58. The display 56 is operable in an inverted position for wall-mounted applications. The underside of the panel 57 provides space for a computer board 68. For further description of time recorder programming, reference can be made to U.S. patent application Ser. No. 08/368,988, filed Jan. 5, 1995, incorporated herein by reference.

Turning to FIG. 3B, the right side of the inner frame 20 is now visible. This figure offers a better view of the mounting sleeve 52 and mounting slots 54 which interface with the mounting box 38 of the base 22, as described above. A cam follower 62 is integrated on the inner frame 20 for interacting with the lifting cam 110 of the barrel cam 104 for raising and lowering the printer frame 24 relative to the base 22. This interaction is described in further detail below. A ribbon cable support 64 is also formed on the right side of the inner frame 20 for supporting the printer ribbon cable 140 (see FIG. 1) during a print sequence and to relieve the tension of the printer cable 140 from a terminal located on the computer board 68.

Figure 3C:
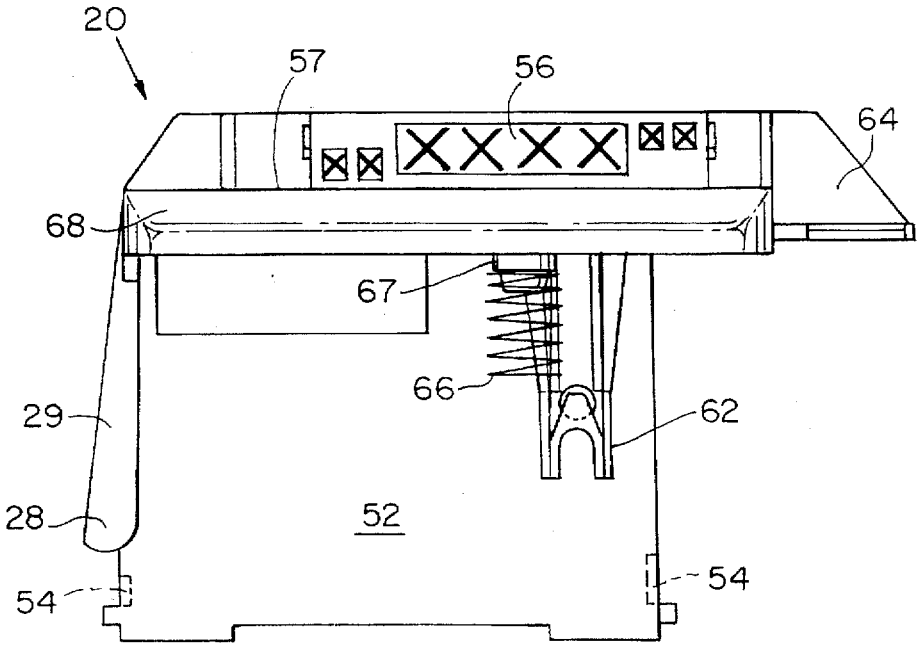
FIG. 3C is a front view of the inner frame.

FIG. 3C is a front view of the inner frame 20. A spring locator 67 is formed on the underside of the top panel 57 of the inner frame 20. A spring 66 communicates with the spring locator 67 and compresses between the underside of the inner frame 20 and a locator 72 formed in the top side of the printer frame 24 (shown in FIG. 4) when the printer frame 24 is raised relative to the base 22 by the lifting cam 110. During a print cycle, the compressive force of the spring 66 pushes the printer frame 24 against the base 22 for securing the document during printing.

Figure 4A:
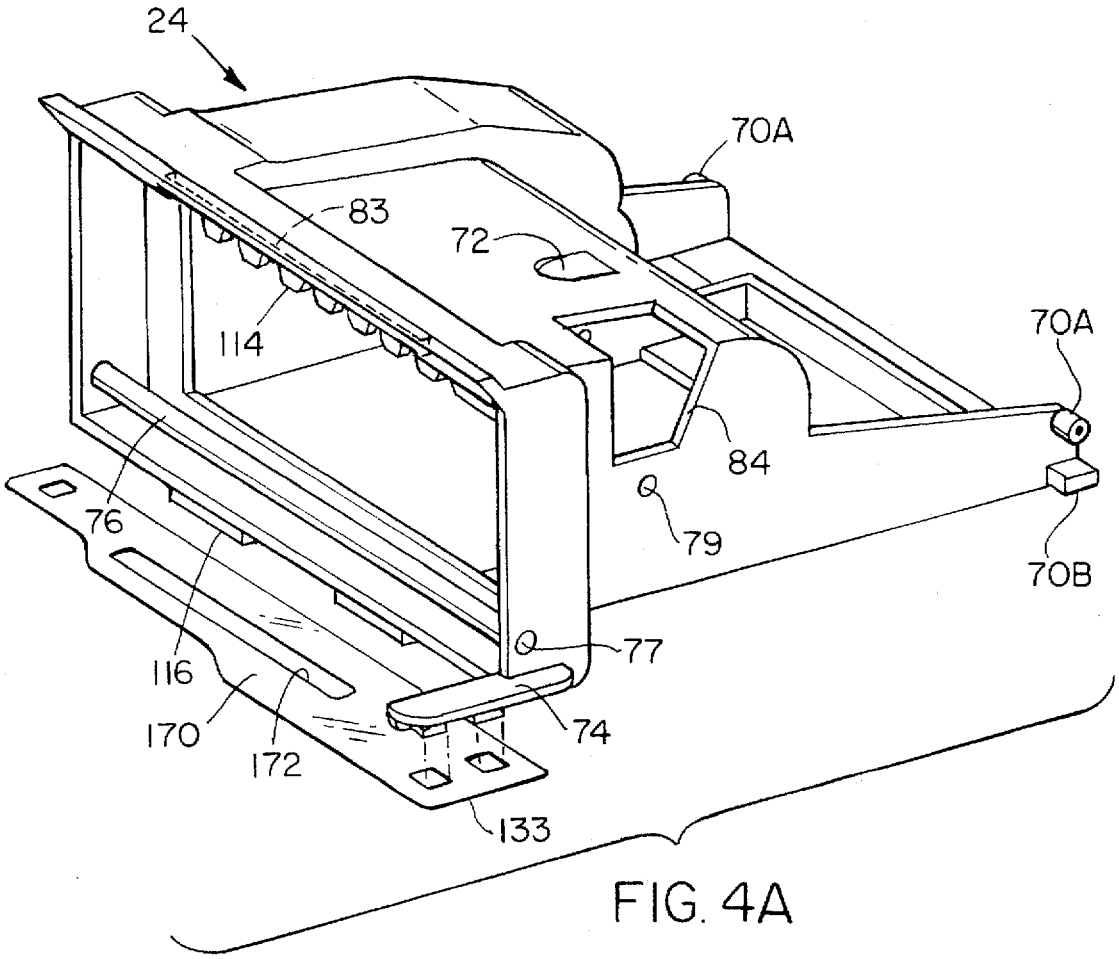
FIG. 4A is a rear perspective view of the printer frame.
Figure 4B:
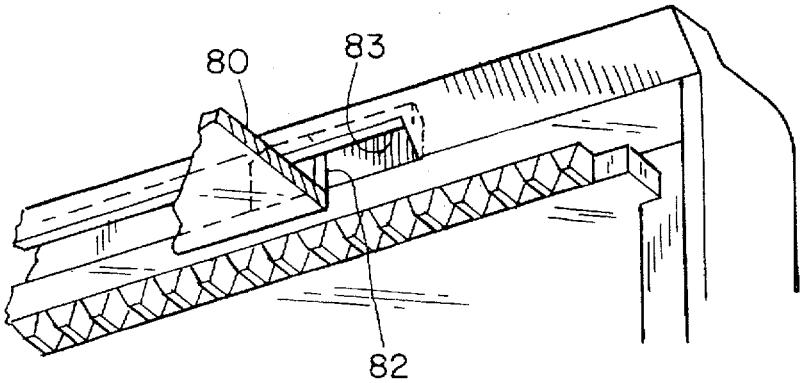
FIG. 4B is a close-up view of the interface between the printer frame and the print carriage.
Figure 4C:
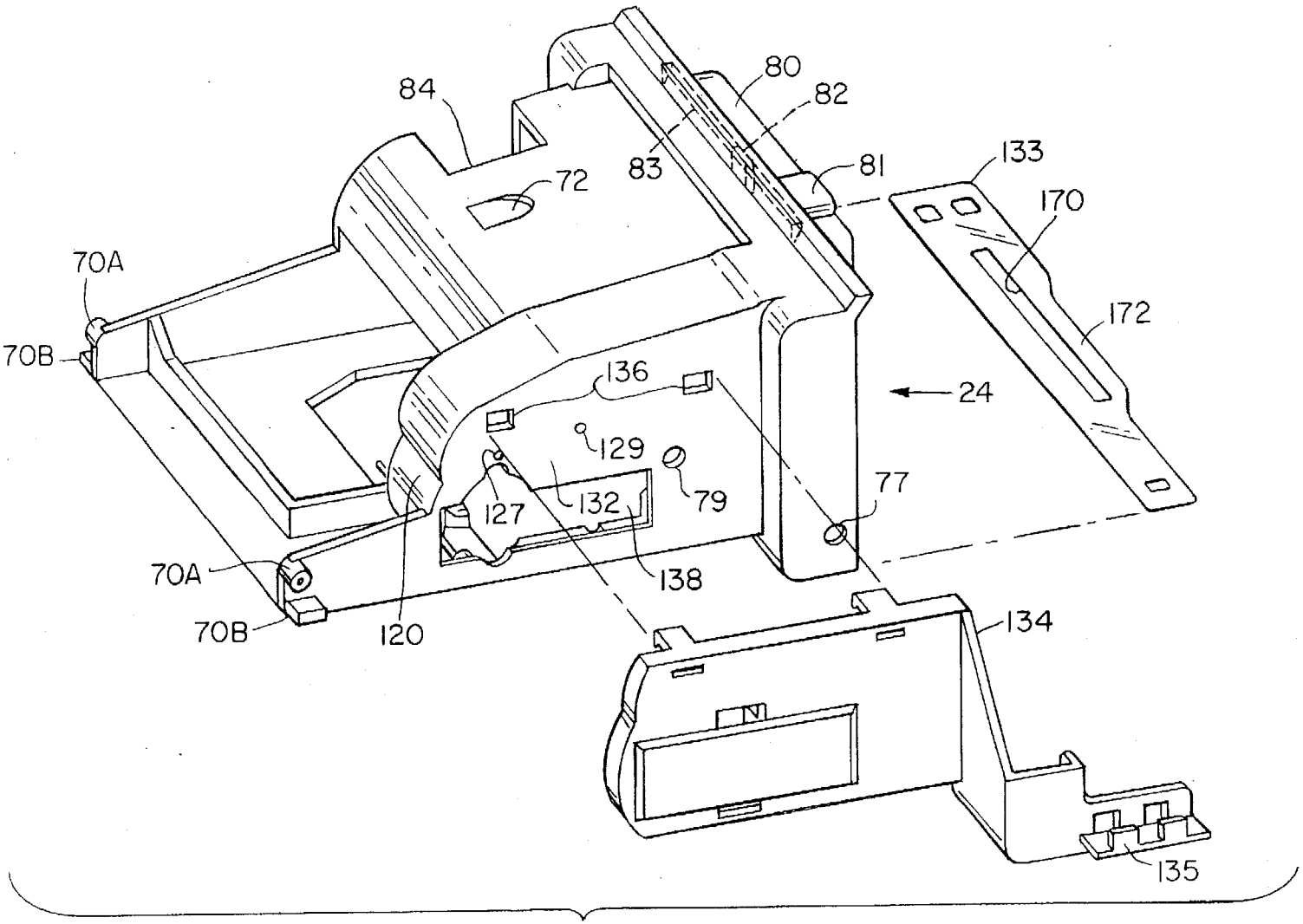
FIG. 4C is a front perspective view of the printer frame.

FIGS. 4A and 4C are rear and front perspective views of the printer frame 24. The frame 24 includes a pair of pivot pins 70A and a pair of locking pins 70B. The pivot pins 70A communicate with the circular pivot supports 28 (see FIG. 3A) of the inner frame 20. The locking pins 70B prevent removal of the printer frame 24 from the inner frame 20 during normal operation. The top of the printer frame includes a second spring locator 72 for positioning the spring 66 (see FIG. 3C) between the inner frame 20 and the printer frame 24. A hole 84 is provided to allow the cam follower 62 of the inner frame 20 to be suspended within the printer frame 24 so that the cam follower 62 can interface with the lifting cam 110 formed on the barrel cam 104. The barrel cam 104 revolves around an axle 78 which is mounted through holes 79 in the printer frame 24.

Figure 8:
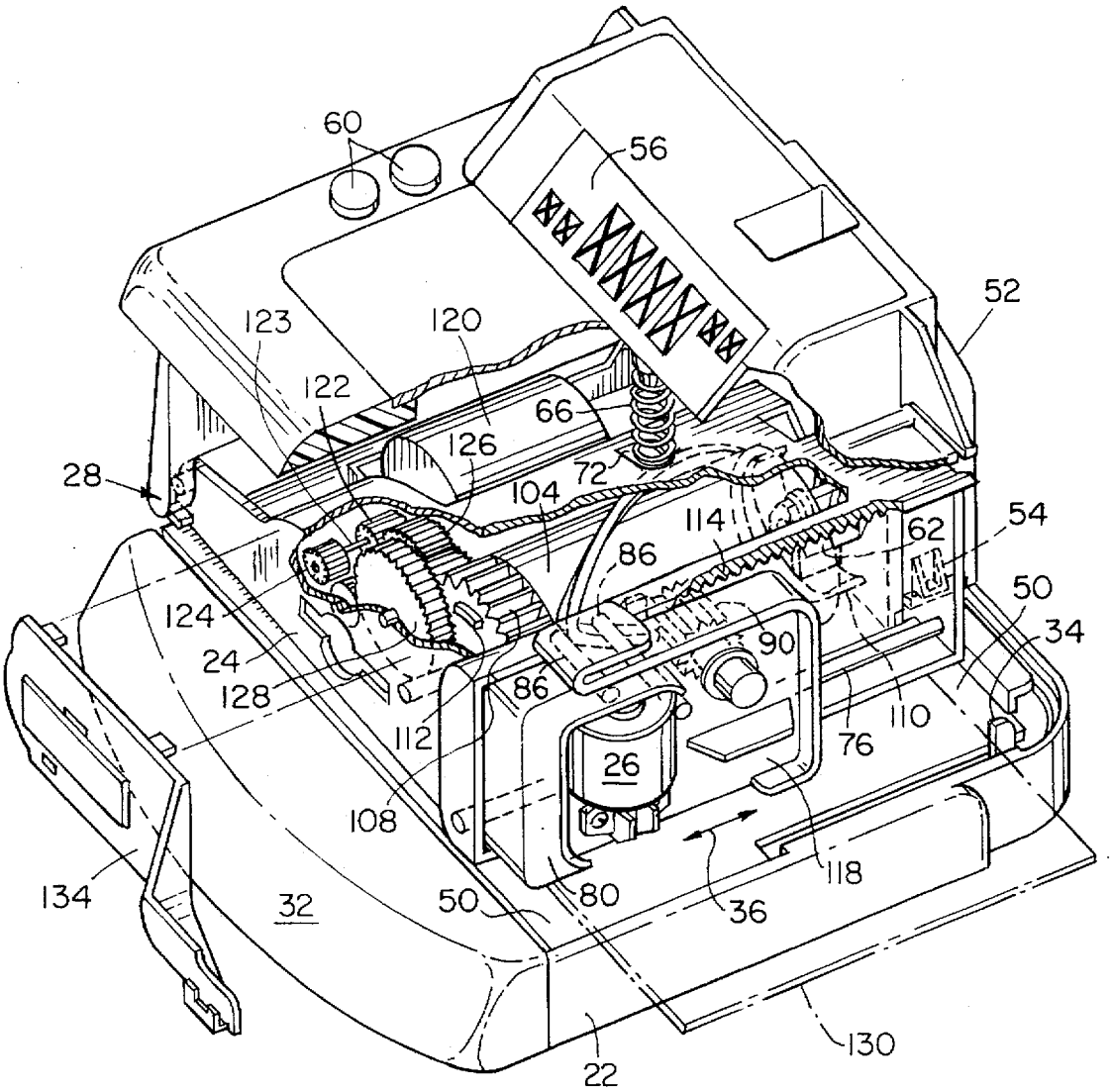
FIG. 8 is a sectional perspective view of the assembled components of the time recorder.

Turning to FIG. 4C, the printer frame 24 includes space for a motor 120, a gear box 132 and space 138 for an electronics board (not shown). As shown in FIG. 8, a motor pinion 122 and a position encoder 124 are keyed to the motor axle 123. The motor pinion 122 meshes with a first reduction gear 126 which in turn meshes with a second reduction gear 128. The combined reduction ratio is 30:1. The second reduction gear 128 meshes with a pinion 108 formed on the barrel cam 104. In this way, the motor 120 causes rotational motion in the barrel cam 104. Turning back to FIG. 4C, the gear box 132 includes a first hole 127 for mounting the axle of the first reduction gear 126 and a second hole 129 for mounting the axle of the second reduction gear 128. The electronics board includes sensors for monitoring the position encoder 124 of the motor 120.

In FIG. 4A, a ribbon rack 114, formed on the printer frame 24, meshes with a ribbon pinion 90 (shown in FIG. 6C) located on the print carriage 80. A printer guide rod 76, mounted in holes 77, supports the printer carriage 80 during printing. A groove 83, formed on the underside of the top of the printer frame 24, interfaces with a tab 82 formed in the print carriage 80. A close-up of this interface is shown in FIG. 4B. The groove 83 and printer guide rod 76 jointly support the print carriage 80 during a print cycle. Rubber feet 116 rest on the print medium when the printer frame 24 is pressed against the base 22.

As shown in FIG. 4C, a print shield holder 134, snaps into slots 136 on the side of the printer frame 24 for containing the electronics board and for securing the reduction gear axles 127, 129, the printer guide rod 77 and the barrel cam axle 79 in their holes. A print shield 133 mounts between shield supports 74,135, on opposite sides of the front face of the printer frame. The print shield 133 is a thin sheet of mylar film which includes a slit 170 for allowing the printer 26 to print on the print medium and a mask 172 to protect the remainder of the print medium from becoming blemished with stray ink.

Figure 5B:
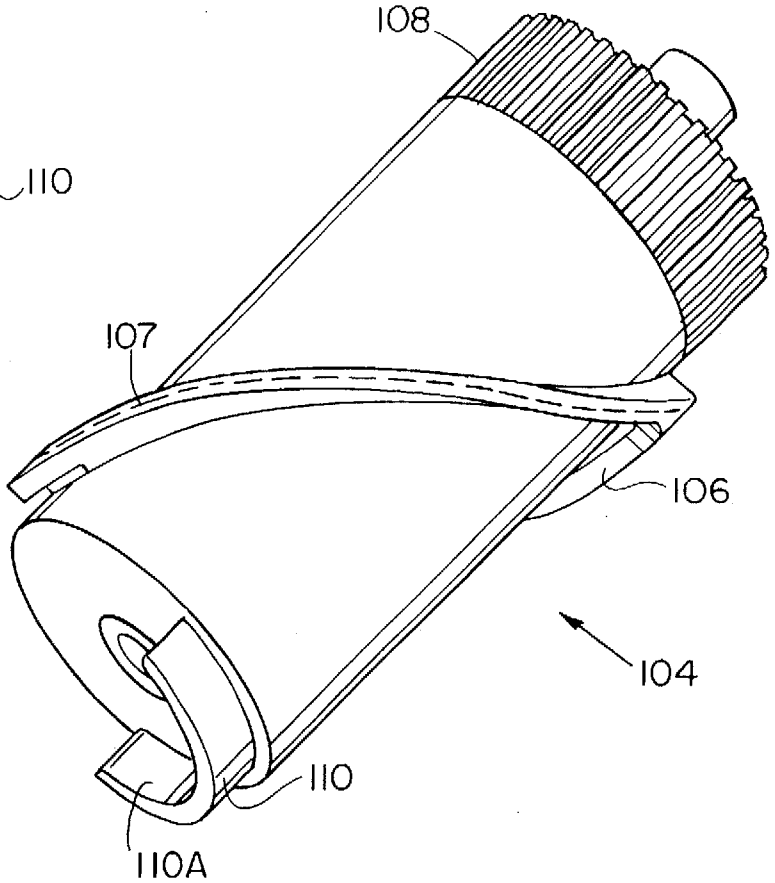
FIGS. 5A and 5B are front and rear perspective views respectively of the barrel cam for a time recorder in accordance with the present invention.
Figure 5A:
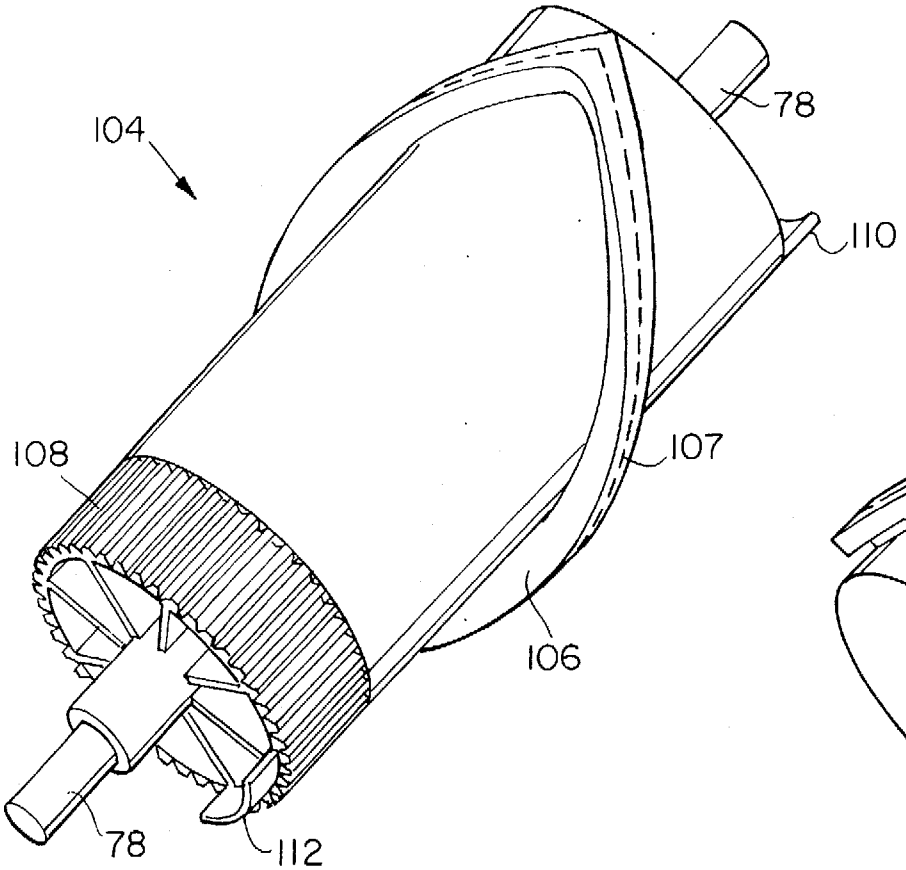

FIGS. 5A and 5B are perspective views of the barrel cam 104. The barrel cam 104 rotates about an axle 78 mounted in the printer frame 24 as described above. Predominant features of the barrel cam include a pinion 108, a rail 106, a position indicator 112, and a cam protrusion 110. The pinion 108 meshes with the second reduction gear 128 driven by the motor 120 (see FIG. 8), which induces rotational motion in the barrel cam 104. As the barrel cam 104 rotates, a rail 106 interfaces with rail followers 86 formed on the print carriage 80 (shown in FIG. 6) for translating the rotational motion of the barrel cam 104 to axial motion in the printer carriage 80 along the axis of the barrel cam 104. The protrusion 110 operates as a lifting cam for lifting the printer frame 24 relative to the base 22 by interfacing with the cam follower 62 located on the inner frame 20 (see FIG. 3B). During each revolution of the barrel cam 104, the inner face 110A of the protrusion 110 engages the top of the cam follower 62. As the protrusion 110 rotates off the cam follower 62, the printer frame 24, loaded by the spring 66, presses against the base 22 to secure the print medium 130 for printing.

Some prior art time recorder barrel cams use a groove rather than a rail 106 for inducing axial motion in the printer 26. In these systems, the printer carriage usually includes a pin which slides in the groove. Some grooved barrel cams have rails on either side of the groove to help prevent wear of the groove and pin and to help locate the pin in the groove. It is impossible to form grooved barrel cams in a single piece with a two-piece mold as the formed cam cannot be removed without breaking the mold. For this reason, barrel cams of the prior art are formed in more than one piece, which are commonly glued or snapped together.

In contrast, the barrel cam 104 of the present invention can be injection molded in a single piece. Two mold pieces can be fitted to join at the center of the rail 106 along dashed line 107. In this way, the barrel cam 104 can be injection molded and each mold piece can thereafter be slid off the formed barrel cam along its longitudinal axis, leaving a single-piece barrel cam.

Figure 6A:
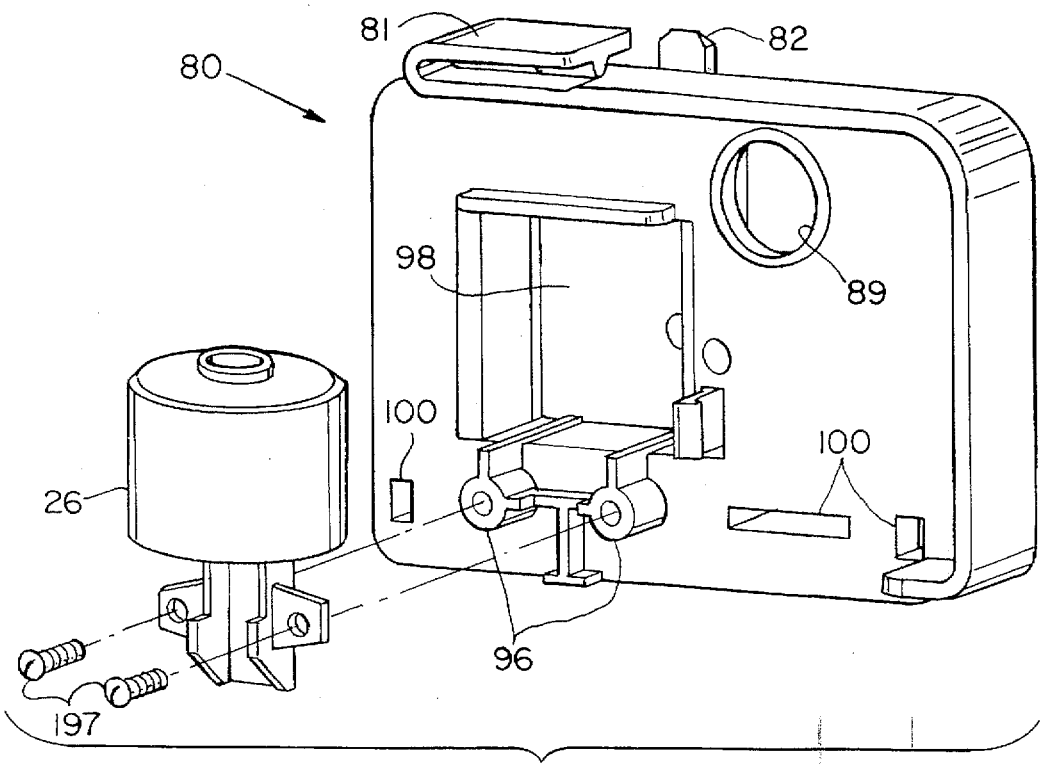
FIGS. 6A and 6B are front and rear perspective views respectively of the print carriage for a time recorder in accordance with the present invention.
Figure 6B:
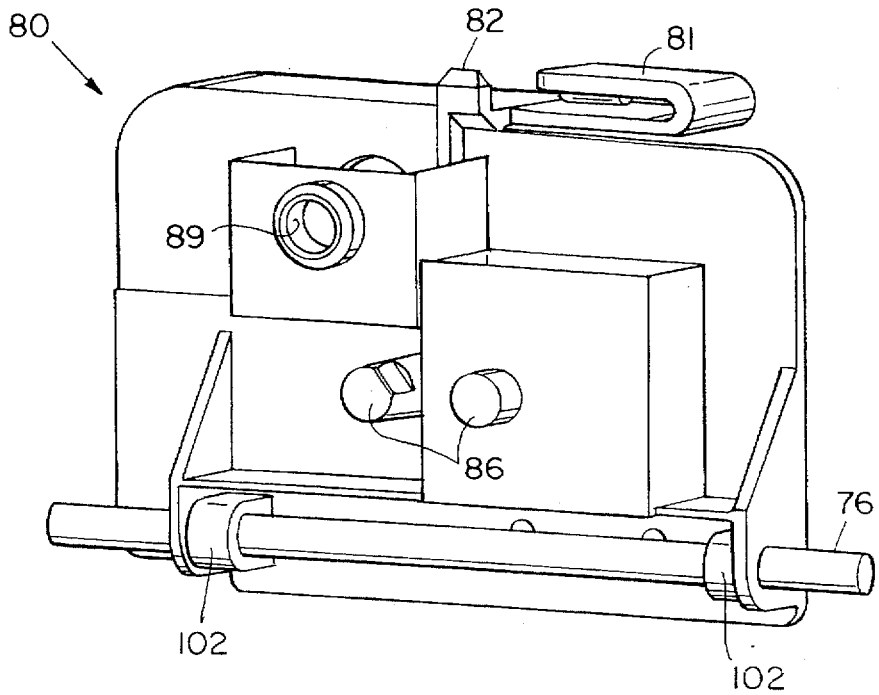

FIGS. 6A and 6B are front and rear perspective views of the print carriage 80. The print carriage 80 includes a tab 82 for slidably interfacing with the print carriage groove 83 (see FIG. 4B) on the printer frame 24. The printer guide rod 76, mounted at the front of the printer frame 24 (see FIG. 4A) further supports the print carriage 80. Rod supports 102 are molded on the rear face (FIG. 6B) of the print carriage 80, supporting the print carriage 80 as it slides across the guide rod 76. Also molded onto the rear of the print carriage 80 are rail followers 86, which communicate with the barrel cam rail 106 (see FIGS. 5A and 5B). A programmable printer 26 mounts in a printer support 98 formed on the front face of the print carriage 80. The printer 26 is secured by screws 197 mounted in the printer mounting holes 96. The printer elements are activated by a controller mounted on the computer board 68 (see FIG. 3A) which communicates with the printer 26 via the ribbon cable 140 (see FIG. 1). A ribbon cable director 81 is formed on the top surface of the carriage to guide the ribbon cable from the printer carriage 80 to the ribbon cable support 64 on the inner frame 20 (see FIG. 3B). Slots 100 on the front face of the printer carriage 80 interface with tabs formed on a ribbon cartridge 118 as shown in FIG. 1.

Figure 6C:
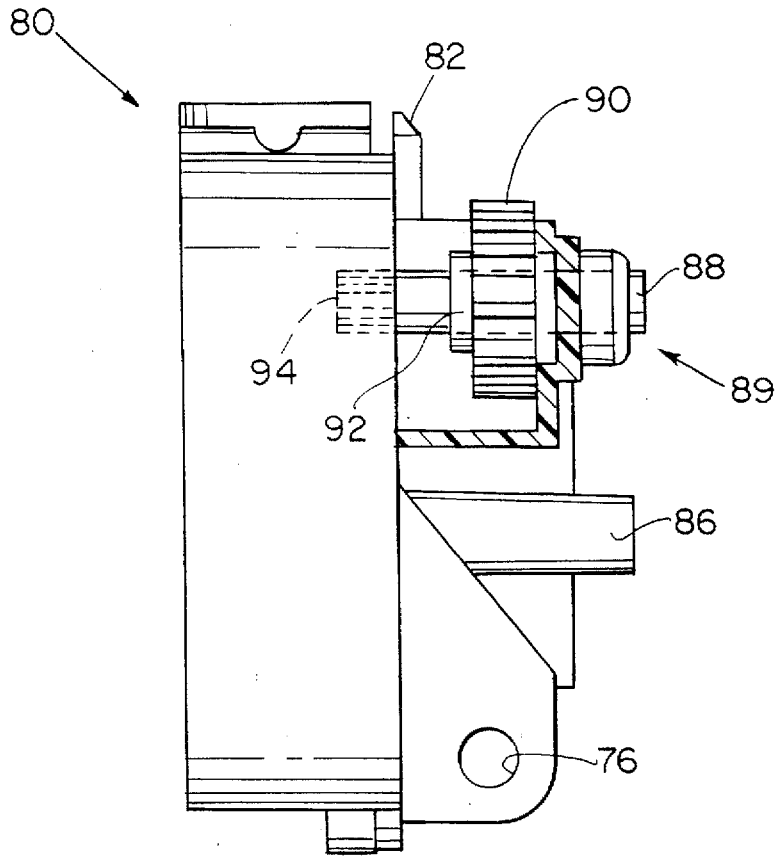
FIG. 6C is a sectional side view of the print carriage.

FIG. 6C is a side view of the print carriage 80. A ribbon pinion shaft 88 is rotatably mounted through a hole 89 extending through the print carriage 80. A clutch 92 is keyed to the shaft 88. The clutch 92 is driven by a ribbon feed pinion 90 which meshes with the ribbon rack 114 (see FIG. 4A) as the print carriage 80 traverses during a print cycle. The clutch 92 is a one-way clutch such that the pinion 90 causes the shaft 88 to rotate as the printer traverses in a first direction and causes the shaft 88 to be stationary as the printer traverses in a second direction opposite the first direction. The shaft 88 includes a pinion extension 94, formed on one end of the shaft 88 which interfaces with the ribbon cartridge 118 (see FIG. 1) for advancing the ribbon automatically during a print sequence.

Figure 7A:
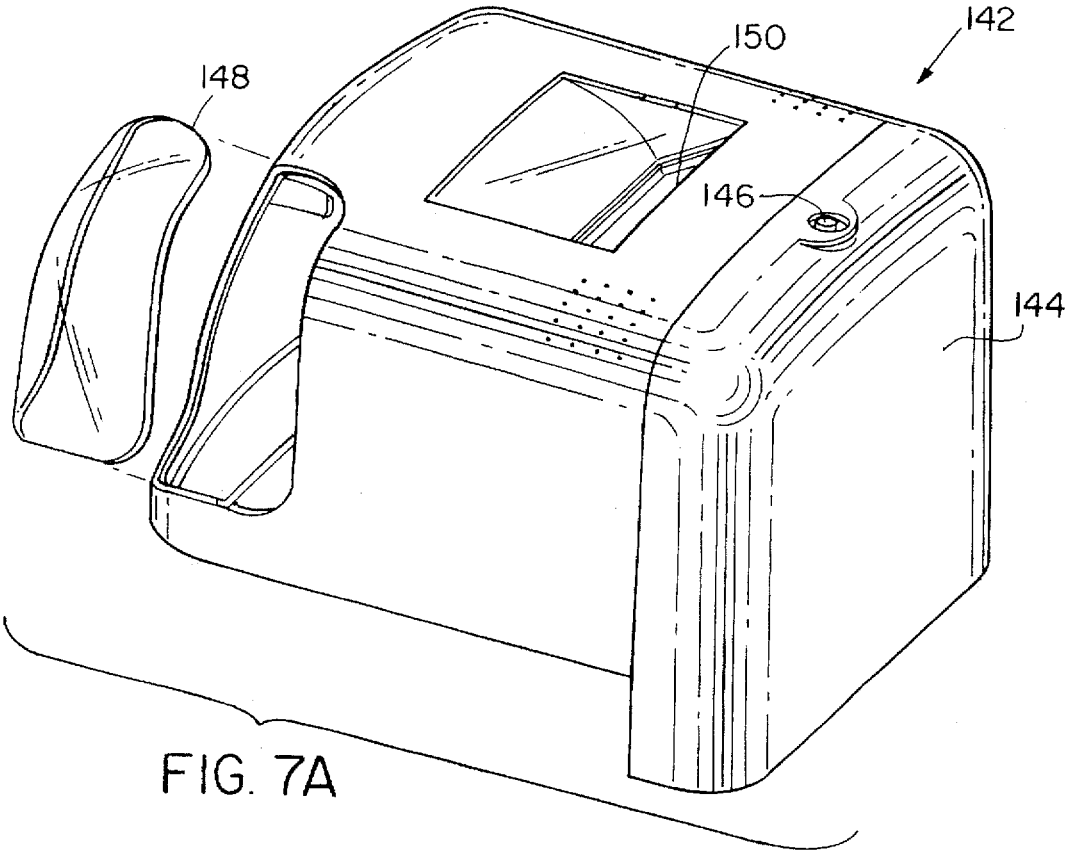
FIGS. 7A and 7B are top and bottom perspective views respectively of the outer cover for a time recorder in accordance with the present invention.
Figure 7B:
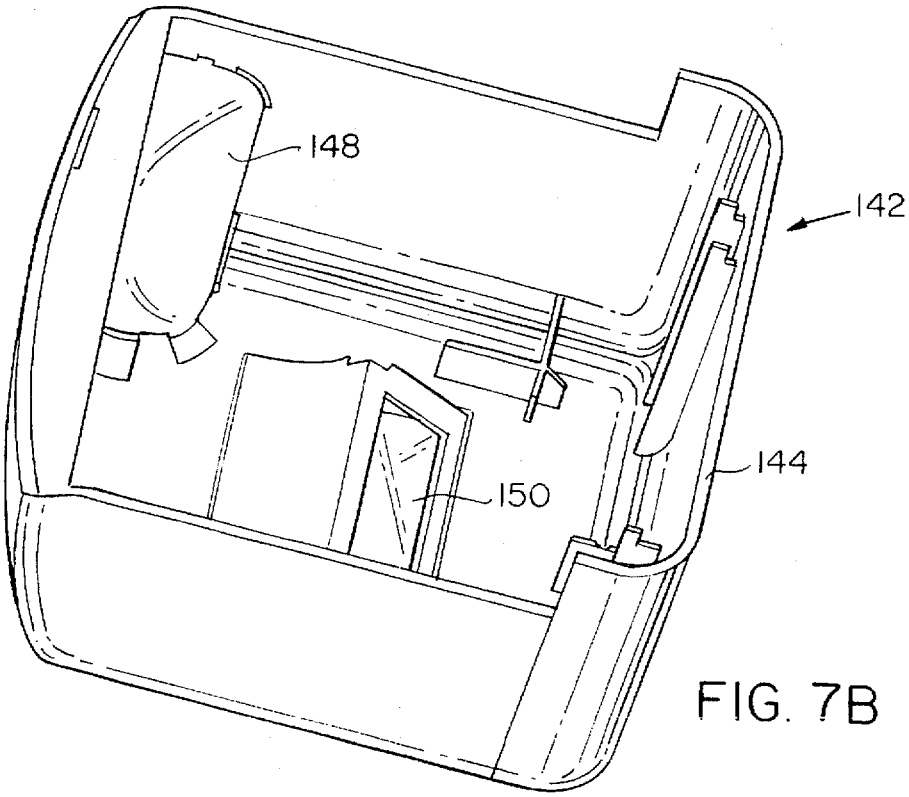

FIG. 7A and FIG. 7B are top and bottom views respectively of a time recorder cover 142. A rear portion of the cover 144 slides over the mounting box 52 of the inner frame 20. A key locking mechanism 146 locks the cover 142 to the inner frame 20. A viewing window 148 allows the user to view the alignment of the print medium 130 relative to the printer. The window 148 snaps on the cover 142. A display window 150 allows the user to view the display 56 mounted on the inner frame 20 (See FIG. 1). The cover 142 can be removed for servicing and for programming the time recorder.

Figure 9A:
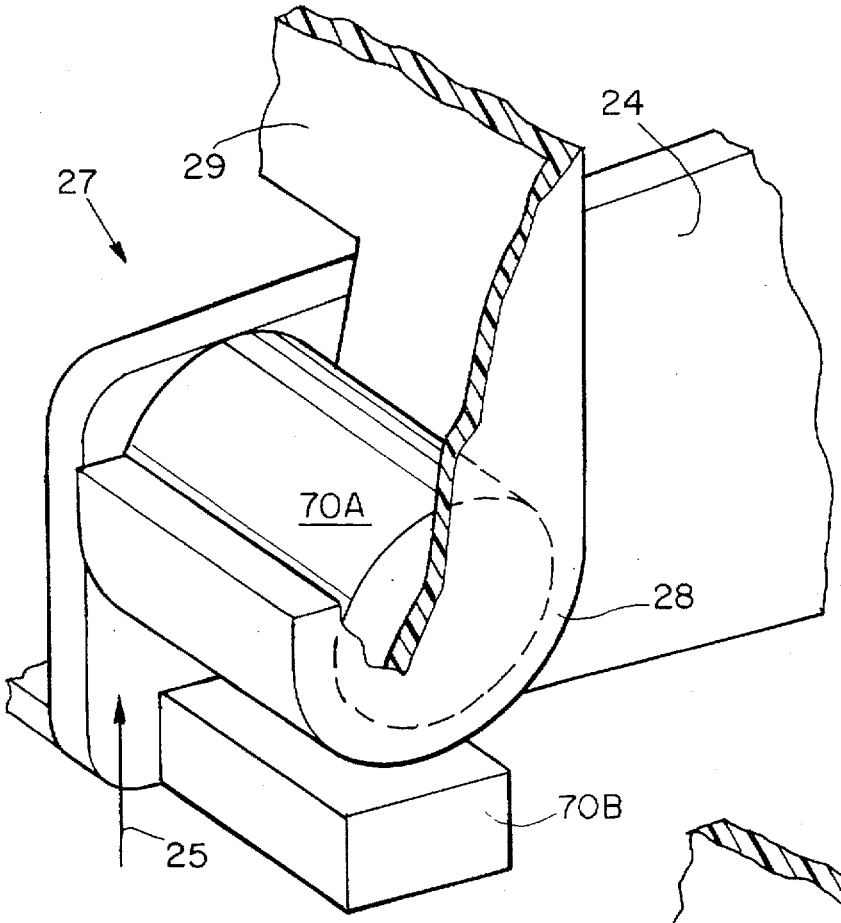
FIGS. 9A and 9B are close-up sectional perspective views of the pivot for coupling the printer assembly to the inner frame in accordance with the present invention.
Figure 9B:
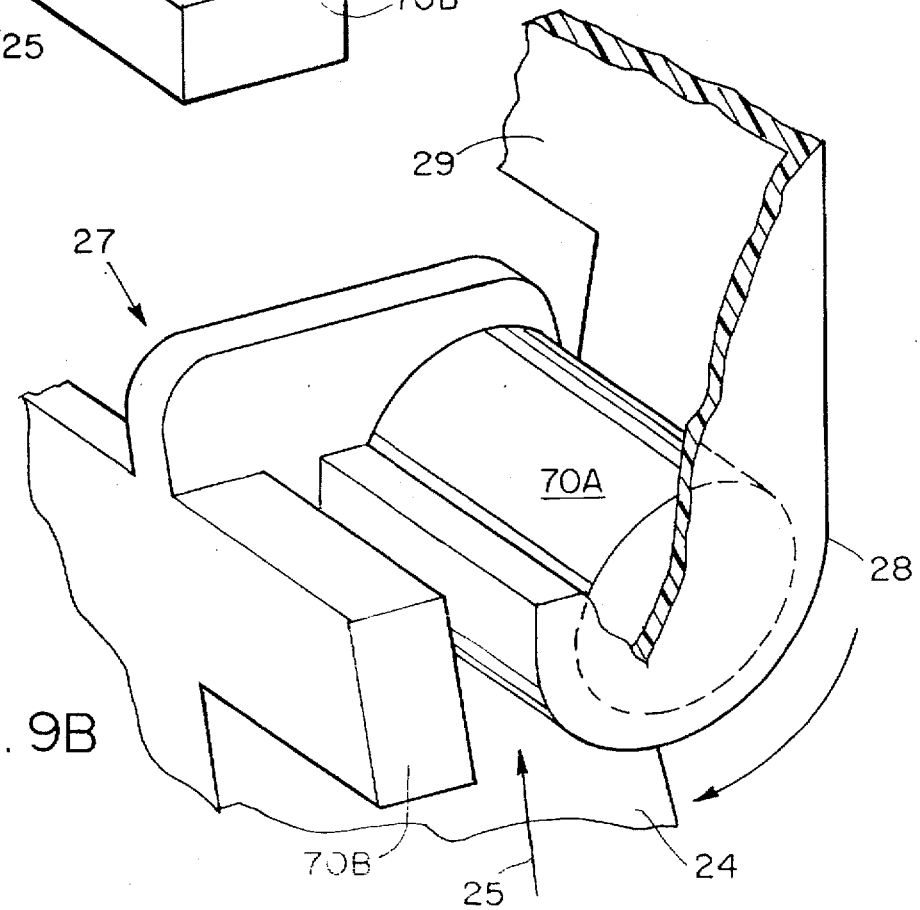

FIGS. 9A and 9B are close-up sectional perspective views of the pivot 27 for coupling the printer frame 24 to the side wall 29 of the inner frame 20. As stated above, pivot supports 28 are formed in the side wall 29 of the inner frame, one on each side of the side wall 29. A pivot pin 70A and a locking pin 70B are formed on each side of the printer frame 24. The pivot pin 70A is preferably circular in shape so that it communicates smoothly with the circular pivot supports 28. During normal operation, the printer frame 24 undergoes minimal rotation, for example 2°–4°, about the pivot pin 70A. With minimal rotation, the locking pin 70B prevents the pivot pin 70A from releasing from the pivot support 28. For example, in the operational position shown in FIG. 9A, if the rear of the printer frame 24 were raised vertically in the direction shown by arrow 25, the locking pin 70B would strike the side of the pivot support 28 and prevent the pivot pin 70A from releasing therefrom. The base 22 prevents the printer frame 24 from rotating downwardly by more than a few degrees, and thus, during normal operation, the printer frame 24 will not release from the inner frame 20. However, if the inner frame 20 and printer frame 24 are jointly removed from the base 22, the printer frame 24 can rotate by more than a few degrees about pivot pin 70A as shown in FIG. 9B. If the printer frame 24 is rotated far enough, the locking pin 70B will no longer be in contact with the pivot support 28 and thus, if the printer frame 24 is moved vertically, in the direction of arrow 25 the printer frame 24 can then be separated from the inner frame 20.

This now completes a description of the preferred embodiment of the invention. The operation of the preferred embodiment of the invention will now be described in conjunction with FIG. 8 which is a sectional perspective view of the time recorder with the cover removed to facilitate viewing of the internal mechanics. At the start of a print cycle, the lifting cam 110 on the barrel cam 104 engages the top of the cam follower 62 on the inner frame 20. This separates the printer frame 24 and the base 22, allowing for insertion of a print medium 130 therebetween. A user inserts a print medium 130, and aligns it by peering through the print window 148 on the cover (see FIG. 7), resting the print medium against the card stop 34. In manual mode, upon insertion of a document 130, the controller waits for the user to press the manual switch 32 to start the printing process. In automatic mode, a sensor detects the presence of the print medium 130 and the controller located on the computer board 68 (see FIG. 3B) automatically initiates a print sequence.

A print sequence begins with activation of the motor 120 by the controller. A position encoder 124, coupled to the motor axle 123, allows a nearby electronics board (see FIG. 4C) to monitor the angular position of the motor axle 123. This gives the controller information on the linear position of the printer 26 at all times during a print cycle. A motor pinion 122, also coupled to the motor axle 123 engages a first reduction gear 126. The first reduction gear 126 meshes with a second reduction gear 128, providing 30:1 total reduction. The second reduction gear 128 meshes with a pinion 108 formed on the barrel cam 104. As the barrel cam 104 rotates, the lifting cam 110 releases from the cam follower 62, as shown in FIG. 8, and the compression of the spring 66 is released, closing the distance between the print frame 24 and the base 22. If the time recorder is mounted on a table in an upright position, the weight of the printer assembly 24 combines with the force of the spring 66 for securing the document 130 between the printer frame 24 and base 22. In a wall-mounted configuration, the spring force alone secures the document 130. The cam follower 62 and lifting cam 110 are shaped such that the lowering of the print frame 24 relative to the base 22 occurs gradually rather than suddenly. As the print frame 24 lowers, it revolves around the pivot 28 approximately 2° to 3°, and the rubber feet 116 (see FIG. 4A) on the underside of the print frame 24 come in contact with the document 130, securing it in place.

The rotational motion of the barrel cam 104 is translated into axial motion in the print carriage 80 through the rail followers 86. This causes the print carriage 80 to traverse across the document 130 in the direction shown by arrow 36. The print carriage 80 slides across the print guide rod 76 and printer carriage groove 83 (see FIG. 4B) and the ribbon rack 114 engages the ribbon feed pinion 90 which incrementally advances the ribbon during printing. The printer 26 prints a programmed message on the document 130.

Upon finishing the line of print, the rail followers 86 engage the far end of the barrel cam rail 106 and begin to induce axial motion in the print carriage 80 in a reverse direction, returning the print carriage 80 to its original position. Although the ribbon feed pinion 90 rotates in an opposite direction during the return trip of the print carriage 80, a one-way clutch 92 (see FIG. 6C) on the ribbon pinion shaft 88 prevents the ribbon from advancing in the opposite direction as described above, and thus, the ribbon stays dormant during the return sequence. As the print carriage 80 returns to its original position, the lifting cam 110 re-engages the cam follower 62, pulling the print frame 24 away from the base 22, allowing for removal of the printed document 130 and insertion of a new document. A position indicator 112 on the barrel cam 104 activates an optical sensor located on the electronics board, which signals the controller that the print sequence has ended. In response, the controller deactivates the motor 120.

The printer 26 of the present invention is fully programmable by the controller, allowing for a wide range of data to be printed on the print medium: company name, trademark, employee name, messages, time, date, characters. The time recorder is useful in a variety of settings: bank, stock exchange, shipping area, mail room, manufacturing floors. For further description of programming of the recorder, reference can be made to U.S. patent application Ser. No. 08/368,988, filed Jan. 5, 1995.

A barrel cam having a groove rather than a rail may be employed for advancing the printer. In this case, the print carriage would have a pin for communicating with the barrel cam groove. Lifting cams may be mounted separately from the barrel cam shaft, rather than being integrated thereon. The recorder can be designed to print on the forward or return cycle of the printer. A impact, thermal, or ink-jet printer may be used. The printer may be driven by the barrel cam as shown above, or may be screw driven, cable driven, or belt driven. Print media include: envelopes, bills of sale, receipts, time cards, labels, blank sheets.

While this invention has been particularly shown and described with references to preferred embodiments thereof, it will be understood by those skilled in the art that various changes in form and details may be made therein without departing from the spirit and scope of the invention as defined by the appended claims.

We claim:

1. A time recorder for printing data on a print medium comprising:

a base for supporting a print medium;

an inner frame erected on the base;

a printer assembly comprising a printer for printing electrically programmable characters, and a barrel cam adapted to drive the printer mechanically across the print medium in full forward and reverse scans with a single revolution; and a pivot for pivotally joining the inner frame and printer assembly such that the printer assembly is moveable about the pivot for reducing the distance between the printer assembly and the base to secure an inserted print medium during printing, and for increasing the distance therebetween to allow for removal of the print medium, the printing operation being independent of the pivot motion.

2. The time recorder of claim 1 further comprising a lifting cam for inducing pivotal movement of the printer assembly about the pivot.

3. The time recorder of claim 1 further comprising a lifting cam for inducing pivotal movement of the printer about the pivot.

4. The time recorder of claim 1 further comprising a spring under compressive force between the printer and the inner frame for forcing the printer against the base.

5. The time recorder of claim 1 wherein the inner frame is suspended above the base for creating space for a print medium to be inserted between the base and the printer.

6. The time recorder of claim 1 wherein the pivot is suspended from the inner frame.

7. The time recorder of claim 1 wherein the inner frame includes an information display and programming buttons over the printer assembly.

8. The time recorder of claim 1 further comprising an outer cover having a viewing window to facilitate alignment of the print medium.

9. The time recorder of claim 1 further comprising a controller for activating the printer.

10. The time recorder of claim 9 further comprising a sensor for sensing the presence of an inserted print medium, and for indicating such to the controller for automatic activation of the printer.

11. The time recorder of claim 9 further comprising a switch for manual activation of the printer.

12. A time recorder for printing data on a print medium comprising:

a base for supporting a print medium;

an inner frame erected on the base;

a printer for printing programmable characters;

a pivot for pivotally joining the inner frame and printer such that the printer is moveable about the pivot for reducing the distance between the printer and the base to secure an inserted print medium during printing, and for increasing the distance therebetween to allow for removal of the print medium, the printing operation being independent of the pivot motion;

a barrel cam adapted to drive the printer during printing; and a lifting cam for inducing pivotal movement of the printer about the pivot, wherein the lifting cam is integrally formed on the barrel cam, and a cam follower is formed on the inner frame; the lifting cam engaging the cam follower for moving the printer relative to the inner frame about the pivot.

13. A time recorder for printing data on a print medium comprising:

a base for supporting a print medium;

an inner frame erected on the base;

a printer for printing programmable characters;

a pivot for pivotally joining the inner frame and printer such that the printer is moveable about the pivot for reducing the distance between the printer and the base to secure an inserted print medium during printing, and for increasing the distance therebetween to allow for removal of the print medium, the printing operation being independent of the pivot motion; and a barrel cam adapted to drive the printer during printing, wherein the barrel cam includes a raised rail for translating rotational movement in the barrel cam to axial movement in the printer.

14. The time recorder of claim 13 wherein the barrel cam is formed in a single piece with two halves of a mold which separate at the rail.

15. A method for printing data on a print medium comprising the steps of:

erecting an inner frame on a base;

coupling a printer, which mechanically scans across a print medium, to the inner frame at a pivot such that the printer is moveable about the pivot; the printer being adapted to print electrically programmable characters;

activating the printer upon insertion of the print medium between the base and printer; the distance between the printer and base being reduced by moving the printer about the pivot to secure an inserted print medium during printing and the distance therebetween being increased to permit removal of the inserted print medium; and driving the printer with a barrel cam when the distance is reduced, the printing operation being independent of the pivot motion.

16. The method of claim 15 further comprising the step of inducing pivotal movement of the printer about the pivot with a lifting cam.

17. The method of claim 15 further comprising the step of inducing pivotal movement of the printer about the pivot with a lifting cam.

18. The method of claim 15 further comprising the step of disposing a spring under compressive force between the printer and the inner frame for forcing the printer against the base.

19. The method of claim 15 further comprising the step of suspending the inner frame above the base for creating space for a print medium to be inserted between the base and the printer.

20. The method of claim 15 further comprising the step of providing an information display and programming buttons on the inner frame.

21. The method of claim 15 further comprising disposing an outer cover around the inner frame and printer, the cover having a viewing window to facilitate alignment of the print medium.

22. A method for printing data on a print medium comprising the steps of:

erecting an inner frame on a base;

coupling a printer to the inner frame at a pivot such that the printer is moveable about the pivot; the printer being adapted to print programmable characters;

forming a lifting cam on a barrel cam and forming a cam follower on the inner frame, the lifting cam engaging the cam follower for moving the printer relative to the inner frame about the pivot;

activating the printer upon insertion of the print medium between the base and printer; the distance between the printer and base being reduced to secure an inserted print medium during printing and the distance therebetween being increased to permit removal of the inserted print medium by inducing pivotal movement of the printer about the pivot with the lifting cam; and driving the printer with the barrel cam in the printing operation independent of the pivot motion.

23. A method for printing data on a print medium comprising the steps of:

erecting an inner frame on a base;

coupling a printer to the inner frame at a pivot such that the printer is moveable about the pivot, the printer being adapted to print programmable characters, and forming a raised rail on a barrel cam for translating rotational movement in the barrel cam to axial movement in the printer;

activating the printer upon insertion of the print medium between the base and printer; the distance between the printer and base being reduced to secure an inserted print medium during printing and the distance therebetween being increased to permit removal of the inserted print medium; and driving the printer with the barrel cam in a printing operation independent of the pivot motion.

24. The method of claim 23, further comprising forming the barrel cam in a single piece with two halves of a mold which separate at the rail.

25. A time recorder for printing data on a print medium comprising:

a base for supporting a print medium;

an inner frame erected on the base having a cam follower integrated thereon; and a printer assembly pivotally mounted on the inner frame comprising:

a barrel cam having a lifting cam adapted to interface with the cam follower;

a printer for printing individual programmable characters on the print medium, the printer being adapted to be driven by the barrel cam in an axial direction relative to the barrel cam; and a motor for rotating the barrel cam, inducing axial movement of the printer in forward and reverse directions, the lifting cam engaging the cam follower to induce movement of the printer assembly relative to the inner frame about the pivot, reducing the distance between the printer and the base to secure the print medium during printing and for increasing the distance therebetween to permit removal of the print medium.

26. A method for printing data on a print medium comprising the steps of:

erecting an inner frame on a base;

coupling a printer assembly to the inner frame at a pivot, the printer assembly having a barrel cam, a printer, and a motor; the barrel cam having a lifting cam adapted to interface with the cam follower; the printer being adapted to be driven by the barrel cam in an axial direction relative to the barrel cam; and activating the motor upon insertion of a print medium between the base and printer assembly; the motor rotating the barrel cam, inducing axial movement of the barrel cam in forward and reverse directions, the lifting cam engaging the cam follower to induce movement of the printer about the pivot for reducing the distance between the printer and the base to secure the print medium during printing, and for increasing the distance therebetween to allow for removal of the print medium.

27. In a programmable time recorder, a barrel cam having a raised rail for driving a printer in forward and reverse axial directions relative to the axis of the barrel cam in a single rotation of the barrel cam.

28. The time recorder of claim 27 wherein the barrel cam is formed in a single piece with two halves of a mold which separate at the rail.

29. A time recorder for printing data on a print medium comprising:

a base for supporting a print medium;

a printer for printing programmable characters; and a barrel cam adapted to drive the printer for printing on a print medium inserted between the printer and the base, the barrel cam having a single raised rail for translating rotational movement in the barrel cam to axial movement in the printer, such that the printer is driven in forward and reverse directions in a single rotation of the barrel cam.

* * * * *